US012241354B1

(12) United States Patent
Stephenson et al.

(10) Patent No.: US 12,241,354 B1
(45) Date of Patent: Mar. 4, 2025

(54) AUTOMATICALLY DETERMINING FLOW TYPE HISTORIES FOR FRACK PUMPS AND MANAGING USAGE THEREOF USING THE FLOW TYPE HISTORIES

(71) Applicant: Halliburton Energy Services, Inc., Houston, TX (US)

(72) Inventors: Stanley Vernon Stephenson, Duncan, OK (US); Harold Grayson Walters, Houston, TX (US); Shahab Jamali Ghare Tape, Houston, TX (US); Joseph A Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/409,532

(22) Filed: Jan. 10, 2024

(51) Int. Cl.

| | |
|---|---|
| ***E21B 43/26*** | (2006.01) |
| ***F04B 15/02*** | (2006.01) |
| ***F04B 23/06*** | (2006.01) |
| ***F04B 49/02*** | (2006.01) |
| ***F04B 49/06*** | (2006.01) |
| ***F04B 49/22*** | (2006.01) |
| ***F04B 51/00*** | (2006.01) |

(52) U.S. Cl.
CPC ..... *E21B 43/2607* (2020.05); *F04B 15/02* (2013.01); *F04B 23/06* (2013.01); *F04B 49/02* (2013.01); *F04B 49/065* (2013.01); *F04B 49/22* (2013.01); *F04B 51/00* (2013.01); *F04B 2205/05* (2013.01); *F04B 2205/09* (2013.01); *F04B 2205/501* (2013.01)

(58) Field of Classification Search
CPC ..... E21B 43/2607; F04B 15/02; F04B 23/06; F04B 49/02; F04B 49/065; F04B 49/22; F04B 51/00; F04B 2205/05; F04B 2205/09; F04B 2205/501
See application file for complete search history.

(56) References Cited

U.S. PATENT DOCUMENTS

| | | | | |
|---|---|---|---|---|
| 9,297,245 | B2 * | 3/2016 | Stephenson | E21B 43/267 |
| 10,583,908 | B2 | 3/2020 | Yin et al. | |
| 10,989,021 | B1 * | 4/2021 | Stephenson | E21B 43/267 |
| 11,371,331 | B2 * | 6/2022 | Surjaatmadja | E21B 43/26 |
| 11,486,385 | B2 * | 11/2022 | Beisel | E21B 43/26 |
| 11,499,544 | B2 | 11/2022 | Beisel | |
| 2005/0064387 | A1 | 3/2005 | Tsutsumi | |
| 2014/0199180 | A1 | 7/2014 | Schoendorff | |

(Continued)

*Primary Examiner* — Charles G Freay
(74) *Attorney, Agent, or Firm* — Michael Jenney; Parker Justiss, P.C.

(57) ABSTRACT

The life of internal components of a frack pump is affected by the frack fluid being pumped. Manually trying to keep track of the frack fluid type being pumped is a tedious task that is susceptible to incorrect data or missing data. As such, the disclosure provides automated tracking of the amount of time or fluid volume that frack pumps pump the different fluid types and managing usage of the frack pumps using a history of the pumping. An example method of managing usage of a frack pump includes: (1) obtaining, for a time period or fluid volume, a proppant presence for a frack fluid being pumped by a frack pump, (2) automatically determining a flow type history for the frack pump over the time period or fluid volume based at least on the proppant presence, and (3) controlling a usage of the frack pump using the flow type history.

22 Claims, 9 Drawing Sheets

(56) References Cited

U.S. PATENT DOCUMENTS

| | | | | |
|---|---|---|---|---|
| 2016/0152889 | A1 | 6/2016 | Hopkins et al. | |
| 2019/0316456 | A1* | 10/2019 | Beisel | E21B 43/267 |
| 2020/0340483 | A1 | 10/2020 | Philipp et al. | |
| 2021/0388703 | A1* | 12/2021 | Hunter | E21B 43/2607 |
| 2022/0113702 | A1 | 4/2022 | Jaaskelainen et al. | |
| 2022/0403734 | A1* | 12/2022 | Jaaskelainen | H04Q 9/00 |
| 2024/0271514 | A1* | 8/2024 | Damm | E21B 43/2607 |

* cited by examiner

400

500

AUTOMATICALLY DETERMINING FLOW TYPE HISTORIES FOR FRACK PUMPS AND MANAGING USAGE THEREOF USING THE FLOW TYPE HISTORIES

CROSS-REFERENCE TO RELATED APPLICATION

This application is related to U.S. application Ser. No. 18/409,574, filed by Stanley Vernon Stephenson, et al. on Jan. 10, 2024, entitled "AUTOMATICALLY DETECTING A KEY PARAMETER AFFECTING PUMP COMPONENTS," commonly assigned with this application and incorporated herein by reference in its entirety.

BACKGROUND

Accessing hydrocarbon reserves, such as gas or oil reserves, typically involves creating a wellbore by drilling into the earth using a drill bit. Various different types of pumps are used in different stages when retrieving the hydrocarbons. Some pumps, such as frack pumps, are located at the surface and are used to pump frack fluid downhole. Maintaining the pumps in proper working condition is important to prevent downtime or prevent reduced functionality of the pumps; both which can be costly. Preventing unnecessary maintenance of the pumps is also important to reduce downtime.

BRIEF DESCRIPTION

Reference is now made to the following descriptions taken in conjunction with the accompanying drawings, in which.

DETAILED DESCRIPTION

Figure 1:
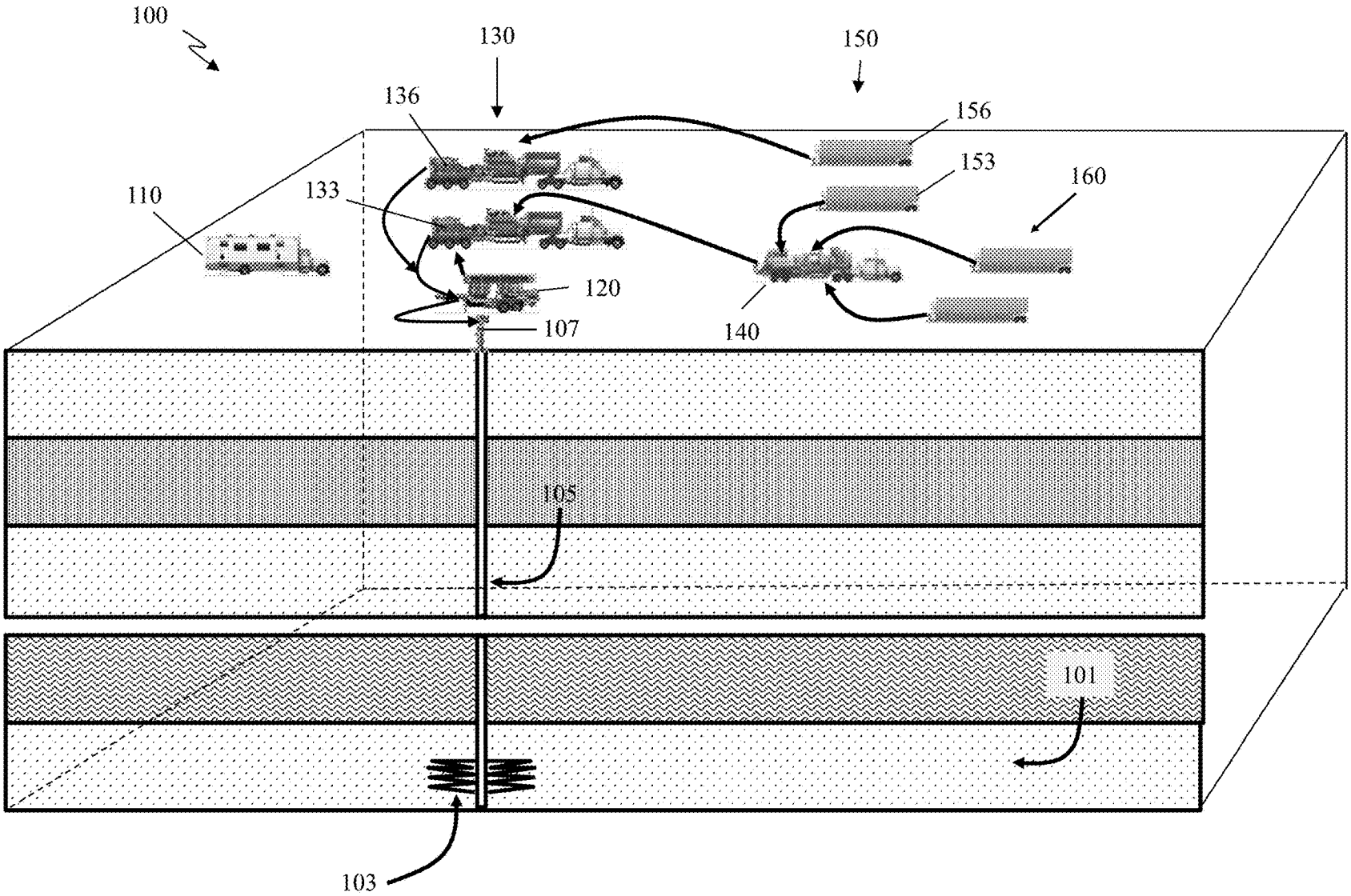
FIG. 1 illustrates a system diagram of an example of a well fracking system including frack pumps that can be managed according to the disclosure.

The life of internal components of a frack pump is affected by the frack fluid being pumped therethrough. The components, such as a fluid end block, valve disks, valve inserts, valve seats, plunger packing, and plungers are all affected by whether the frack pump is pumping frack fluid that is clean fluid or proppant laden fluid. A clean fluid as used herein is a frack fluid that does not include proppant. Over the life of the pump components, the pumps may have had periods of operation on both clean fluid and proppant laden fluid, or simply proppant fluid, which is a frack fluid that includes proppant. Manually trying to keep track of the pumps that pump proppant fluid and for what volume and proppant concentration is a tedious task that is susceptible to incorrect data or missing data; especially when manually recording the data. As such, automated tracking of the amount of time a frack pump pumps the different fluid types would be beneficial.

The disclosure provides a system and method to automatically determine a flow type history for a frack pump. The flow type history includes a type of fluid flow and an amount of time for each of the types of fluid flow. Accordingly, the flow type history can provide, for example, a minute by minute basis of each type of fluid flow for a particular frack pump. The fluid flow types include no flow, clean flow, or slurry flow. No flow is when no frack fluid is flowing through the frack pump. Clean flow is when the frack fluid flowing through the frack pump does not contain proppant, i.e., a clean fluid. Slurry flow is when the frack fluid flowing through the frack pump includes proppant, i.e., proppant fluid. The proppant can be silica sand, resin-coated sand, bauxite, ceramics or combinations thereof. Non-limiting examples include magnesium silicate, glass or synthetic ceramic proppants. A split flow for a well fracking system can also be determined when at least one frack pump is used for clean flow and at least one frack pump is used for slurry flow. The types of fluid flow can be automatically determined based on a proppant presence in the frack fluid. A bulk modulus of the frack fluid can be used to determine the proppant presence. The bulk modulus can be provided by a monitoring system of the frack pump, such as IntelliScan™ Equipment Monitoring System that is available from Halliburton of Houston, Texas. The bulk modulus can be an absolute bulk modulus or a relative bulk modulus that can be validated using one or more operating parameters of the frack pump and/or one or more operating parameters of a fracking system that includes the frack pump. The operating parameters of the frack pump include a pump rate and pump pressure that corresponds to the proppant presence, i.e., the pump rate and pressure when pumping the frack fluid having the proppant. When the bulk modulus is absolute, validation is not necessary. Sensors associated with the frack pump can also be used to determine the proppant presence in a frack fluid. For example, a fluid density sensor or a speed of sound sensor can be used to determine a proppant presence in a frack fluid flowing through a frack pump. Knowing the flow type history, a method of managing usage of a frack pump can be determined. Examples of usage includes retirement, maintenance, and type of operation, such as a dirty pump that is used to pump proppant fluid or a clean pump that is used to pump clean fluid. Changing the type of operation can occur automatically during or between a fracking stage or can occur manually between fracking stages. An automatic valve can be used for automatically changing between the type of operations; including during a fracking stage. One or more pump models can be used for managing the usage.

Managing the usage of frack pumps can be based on the condition of pump components. The flow type history and the one or more pump models can be used for evaluating the condition of pump components. The pump model can be generated according to a method disclosed herein that uses the flow type history of the frack fluid from multiple frack pumps and pumping information associated with the multiple frack pumps and frack fluid. The flow histories for the multiple frack pumps can be normalized according to one or more characteristics of the pump, for example, the pump size (plunger stroke and diameter), pump speed (rpm), pump model, and pump pressure (psi).

Based on the evaluating of the pump components, parameters of the pump can be changed. The parameters include material type of the pump components, manufacturing process of the pump components, and manufacturer. Evaluating of the pump components can also include the consideration of pump related factors, which include manufacturing date, changes in manufacturing process or material.

Turning now to the figures, FIG. 1 illustrates a system diagram of an example of a well fracking system 100 including frack pumps that can be managed according to the disclosure. Once a payzone 101 is identified or reached, a conventional fracturing operation may be used to pump frack fluid to create fractures 103 in a payzone 101 to increase its permeability for the purpose of increasing oil or gas production via wellbore 105 capped by wellhead tree 107, wherein highly connected pore spaces provide high permeability. For example, there can be high porosity but if the pore spaces are not connected, then there can be poor to no flow of hydrocarbons. For horizontal wellbores where the borehole turns from vertical to horizontal into payzone 101, there are typically multiple perforated intervals 103 along the payzone 101. The system 100 includes an operations control unit 110, a manifold unit 120, frack pumps 130, and a blender 140 where proppant (e.g., sand), chemicals, and other fracturing additives can be combined with a fluid for fracking. The system 100 also includes fluid tanks 150, and fracking component storage tanks (proppant storage) 160, such as chemical and proppant storage. The frack pumps 130 include frack pump 133 and frack pump 136 and the fluid tanks 150 include fluid tank 153 and fluid tank 156.

Fluid tank 153 and the proppant storage tanks 160 are coupled to the blender 140 wherein the blender 140 mixes the fluid and proppant to create a proppant fluid. The blender provides the proppant fluid to frack pump 133 to pump to wellbore 105 via the manifold 120 and the well head 107. Accordingly, when pumping the proppant fluid, frack pump 133 is operating as a dirty pump with a slurry flow type. In contrast, fluid tank 156 provides clean fluid to frack pump 136 to pump to the wellbore 105 via the manifold 120 and the well head 107. Accordingly, when pumping the clean fluid, frack pump 136 is operating as a clean pump with a clean flow type.

The system 100 represents a split flow system but one skilled in the art will understand that the features of the disclosure can also be used with a well fracking system that does not use split flow. One skilled in the art will also understand that the system 100 can include a different number of the components represented in FIG. 1, such as having additional frack pumps 130. In addition to the above noted components, the system 100 can include additional components typically used with a well fracking system. For example, pumps (not shown) are typically used to pump the clean fluid, proppant, and proppant fluid between the different components of the system 100. Likewise, various methods (not shown) such as belts, augers, pneumatic systems, gravity based systems and proppant containers moved with forklifts can be used to move the proppant as needed.

The system 100 can also include a monitoring system (not shown) that monitors operation of components of the system 100. The monitoring system can include an IntelliScan system that monitors the operation of the frack pumps 130. The monitoring system can also include sensors that identify the presence of proppant in the frack fluid. The sensors can be located in the frack pumps 130 or in piping proximate the frack pumps. The monitoring data generated by the monitoring system can be sent to the control unit 110 to use in directing the operation of the system 100. The monitoring data can include pumping information from the frack pumps 130, such as one or more of pump operating parameters, pump characteristics, frack fluid characteristics, or characteristics of the proppant. For example, the pump operating parameters can include pressure or flowrate and the pump characteristics can include pump type and pump size of the frack pumps 130. The proppant characteristics can include proppant concentration, proppant type, proppant mesh, and the frack fluid characteristics can include proppant volume and rate, and the total fluid volume of the frack fluid flowing through the frack pumps 130. The pumping information can include a combination of pump operating parameters, pump characteristics, frack fluid characteristics, and proppant characteristics.

The control unit 110 includes a controller that directs operation of the system 100 using the monitoring data and according to a fracking plan for the wellbore 105. For example, the controller can control the operation of the frack pumps 130 and the blender 140 according to the monitoring data and fracking stages. The controller can control the pressure and rate of the frack pumps 130, the blend provided by the blender 140, and the mixture of proppant fluid and clean fluid provided to the wellbore 105.

Figure 2:
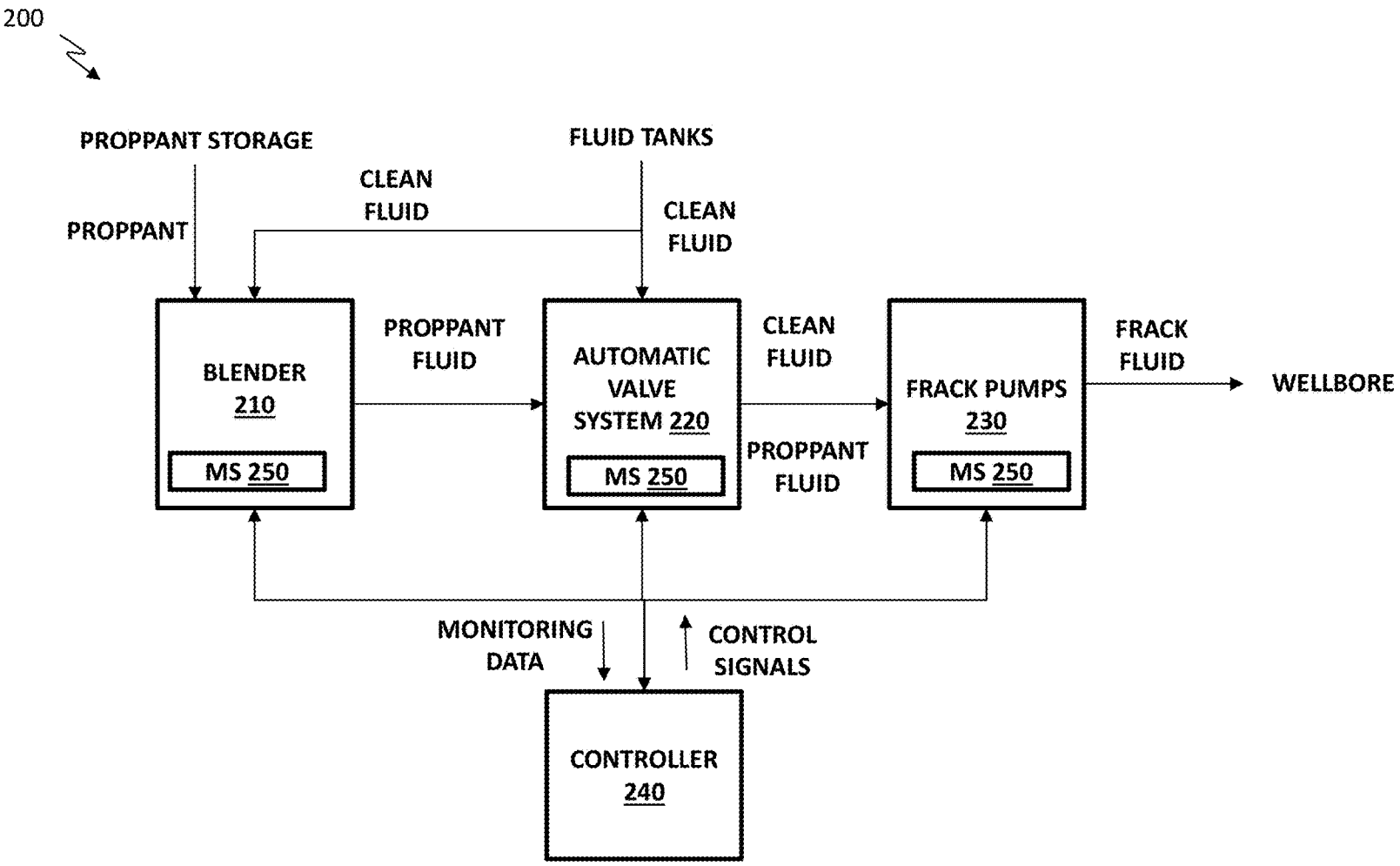
FIG. 2 illustrates a block diagram of an example of a well fracking system constructed according to the principles of the disclosure.

The controller can also control usage of the frack pumps 130 according to the methods disclosed herein. For example, the controller can indicate one of the frack pumps 130 should be removed for maintenance, that frack pump 133 needs to be switched from a dirty pump to a clean pump, or that frack pump 136 should be switched from a clean pump to a dirty pump based on the flow type history of the frack pumps 130. Method 300 provides an example of controlling the usage. The removal for maintenance and switching between pump types can be done between the fracking stages. The change in usage can also be done during a fracking stage when, for example, automatic valves are used and controlled by the controller. The control unit 110 having the controller is located at the wellbore 105 in FIG. 1. A controller located remotely from the wellbore 105 can also be used to control usage of the frack pumps 130; especially changing usage before and after fracking operations. The controller, whether local or remote, can use one or more pump models to control usage of the frack pumps 130. FIG. 2 provides an example of a well fracking system that includes an automatic valve system and a monitoring system.

FIG. 2 illustrates a block diagram of an example of a well fracking system 200 constructed according to the principles of the disclosure. The fracking system 200 performs a fracking operation for a wellbore in fracking stages according to a fracking plan. The well fracking system 200 includes one or more blenders represented by blender 210, an automatic valve system 220, frack pumps 230, a controller 240, and a monitoring system 250. The well fracking system 200 can be used, for example, with wellbore 105 of FIG. 1.

For a fracking stage, the blender 210 receives proppant and clean fluid from storage tanks and mixes the proppant and clean fluid to create a proppant fluid for the fracking operation. The proppant concentration used at the blender is known by the controller 240 according to the fracking plan or is provided to the controller 240 via the monitoring system 250 at the blender 210. The automatic valve system 220 receives the proppant fluid and clean fluid and provides the clean fluid and proppant fluid to the frack pumps 230 for pumping to the wellbore using, for example, a manifold. The clean fluid can be delivered (i.e. pumped) to one or more clean pumps and the proppant fluid can be delivered to one or more dirty pumps representing a split flow. Each of the frack pumps 230 can be used for a slurry flow. The controller 240 can control whether one of the frack pumps 230 is used for clean flow or slurry flow by operating one or more of the valves of the automatic valve system 220. The controller 240 can change the flow type for a particular one of the frack pumps 230 based on the flow type history for the particular one of the frack pumps 230. The controller 240 can compare the flow type history to a pump model to determine if a change of usage is needed. By using the automatic valve system 220, the change of usage can be made during a fracking stage. The controller 240 can also indicate that a usage change for one or more of the frack pumps can be done between fracking stages based on the flow type history. The controller 240 can include one or more processors that control usage of at least one of the frack pumps 230 according to the flow type history of the at least one of the frack pumps 230. The one or more processors can also control the usage based on pump models, such as by comparing a flow type history to a pump model. One or more memories of the controller 240 can include operating instructions that direct the operation of the one or more processors.

Figure 9:
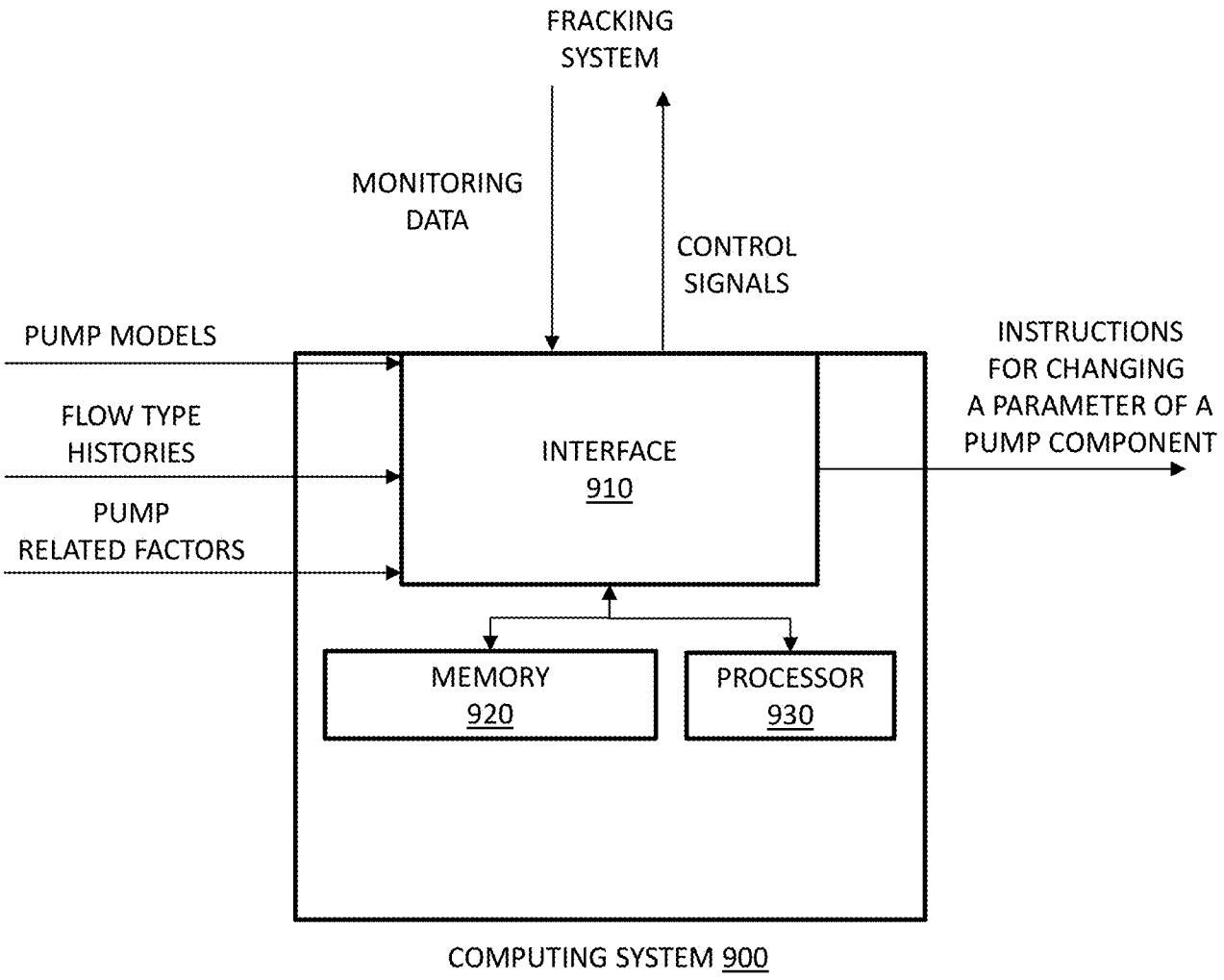
FIG. 9 illustrates a block diagram of an example of a computing system constructed according to the principles of the disclosure.

To direct operation of the automatic valve system 220, the controller 240 can send control signals. The controller 240 can also direct operation of the blender 210 and the frack pumps 230 via control signals. The control signals can be sent via a communication system that is wireless, wired, or a combination thereof. The controller 240 can also receive monitoring data from the monitoring system 250 over the communication system. The controller 240 can include one or more communications interfaces that receives the monitoring data and sends the control signals. FIG. 9 illustrates an example of a computing device or system, such as controller 240.

Monitoring data received from the frack pumps 230 can indicate the type of fluid flow through each of the frack pumps 230. For example, the monitoring data can indicate the presence of proppant within the fluid being pumped through each of the frack pumps 230. As disclosed herein, the proppant presence can be determined by a bulk modulus provided by the monitoring system 250, such as an IntelliScan monitoring system located with the frack pumps 230. Other sensors of the monitoring system 250 as disclosed herein can also be used to detect a proppant presence.

The monitoring data can also include system operating parameters of the well fracking system 200 and pumping information having pump operating parameters of the frack pumps 230. An example of the system operating parameters include the proppant concentration at the blender 210 and examples of the pump operating parameters include the transmission RPM, crank position, fluid end strain gauges, pump rate, and pump pressure of each of the frack pumps 230. The controller 240 can use one or more of the system operating parameters, one or more of the pump operating parameters, or a combination thereof to validate the proppant presence.

Figure 4:
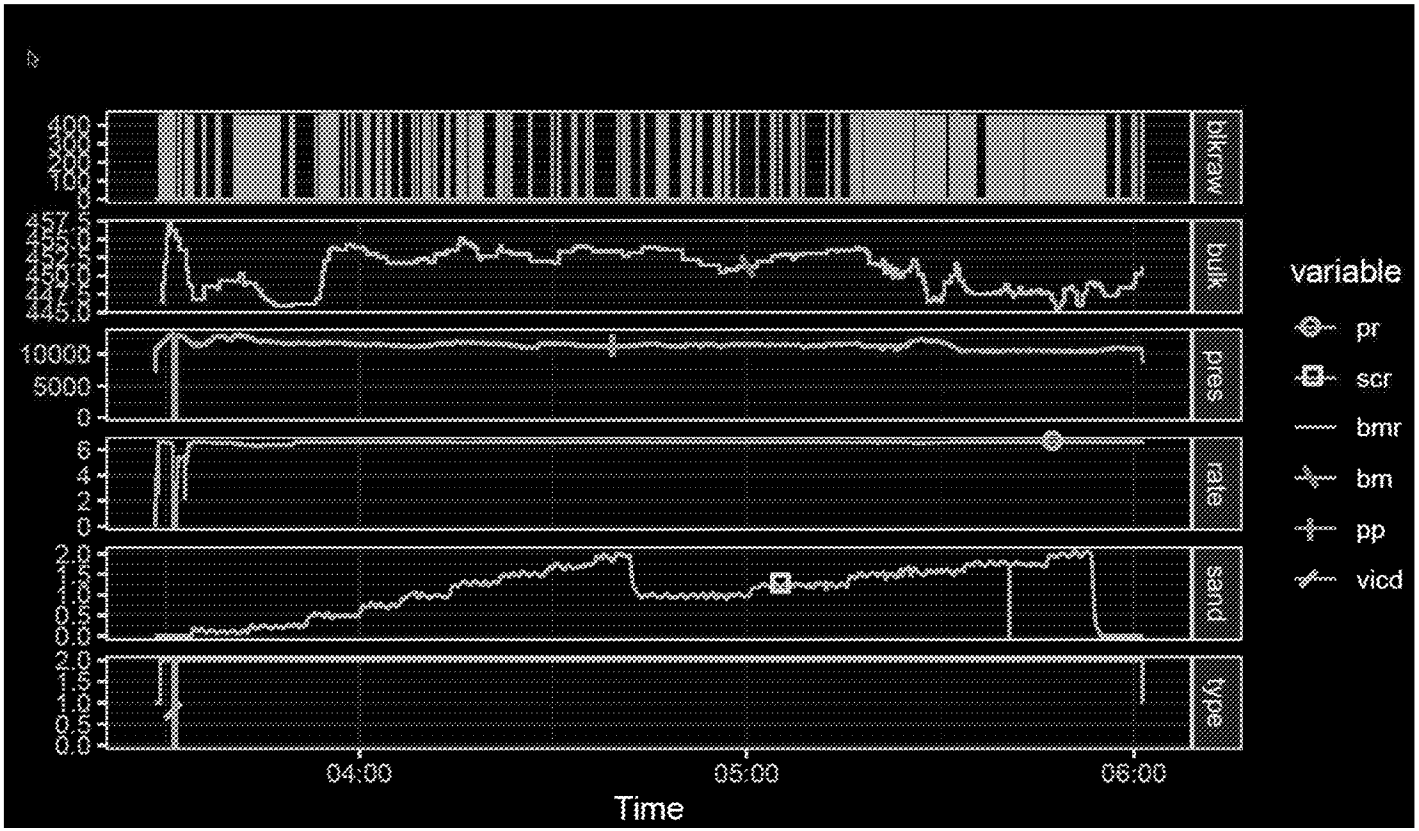
FIG. 4 illustrates a diagram 400 of an example of a flow type history and associated data for a frack pump.
Figure 5:
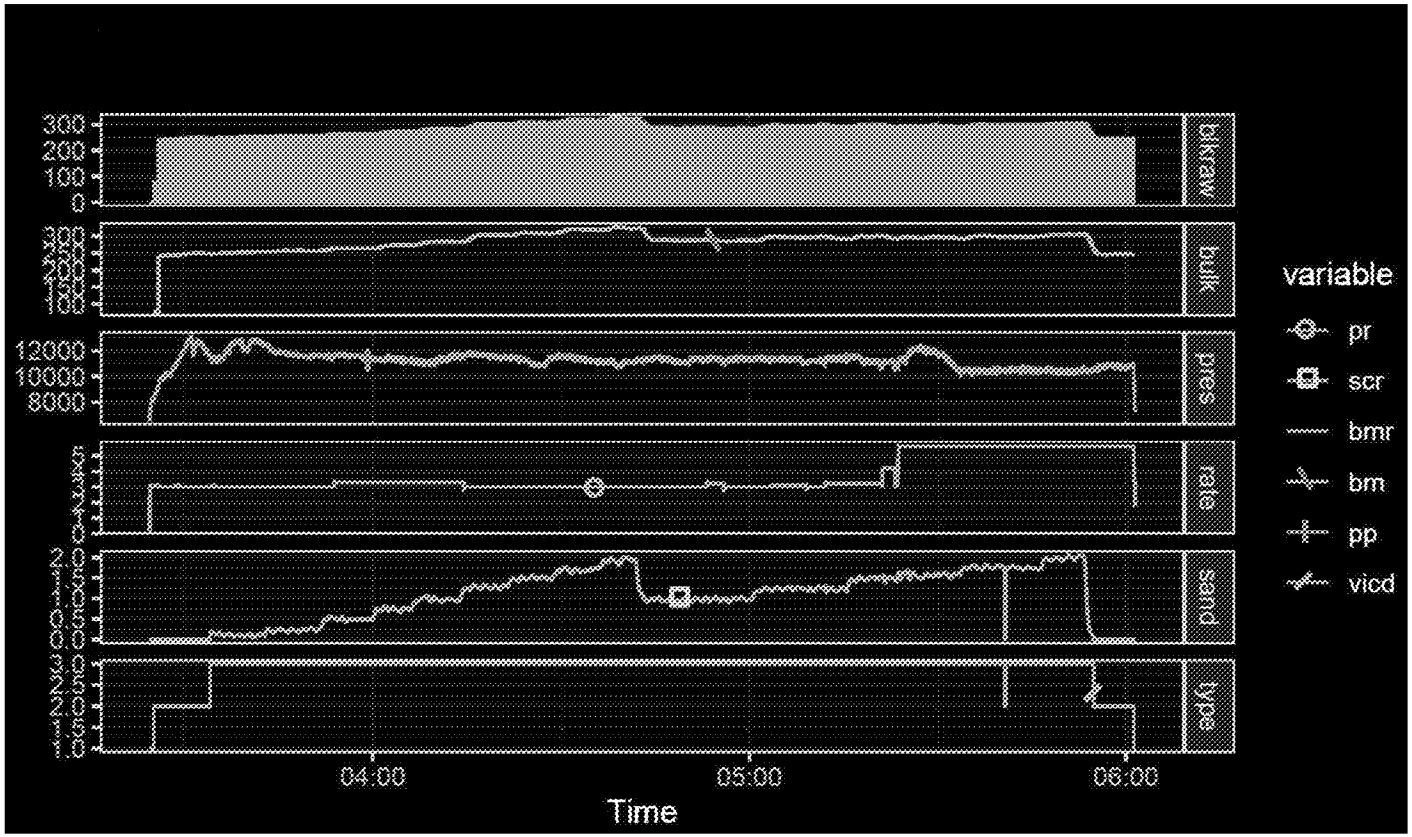
FIG. 5 illustrates a diagram of another example of a flow type history and associated data for a frack pump.
Figure 8:
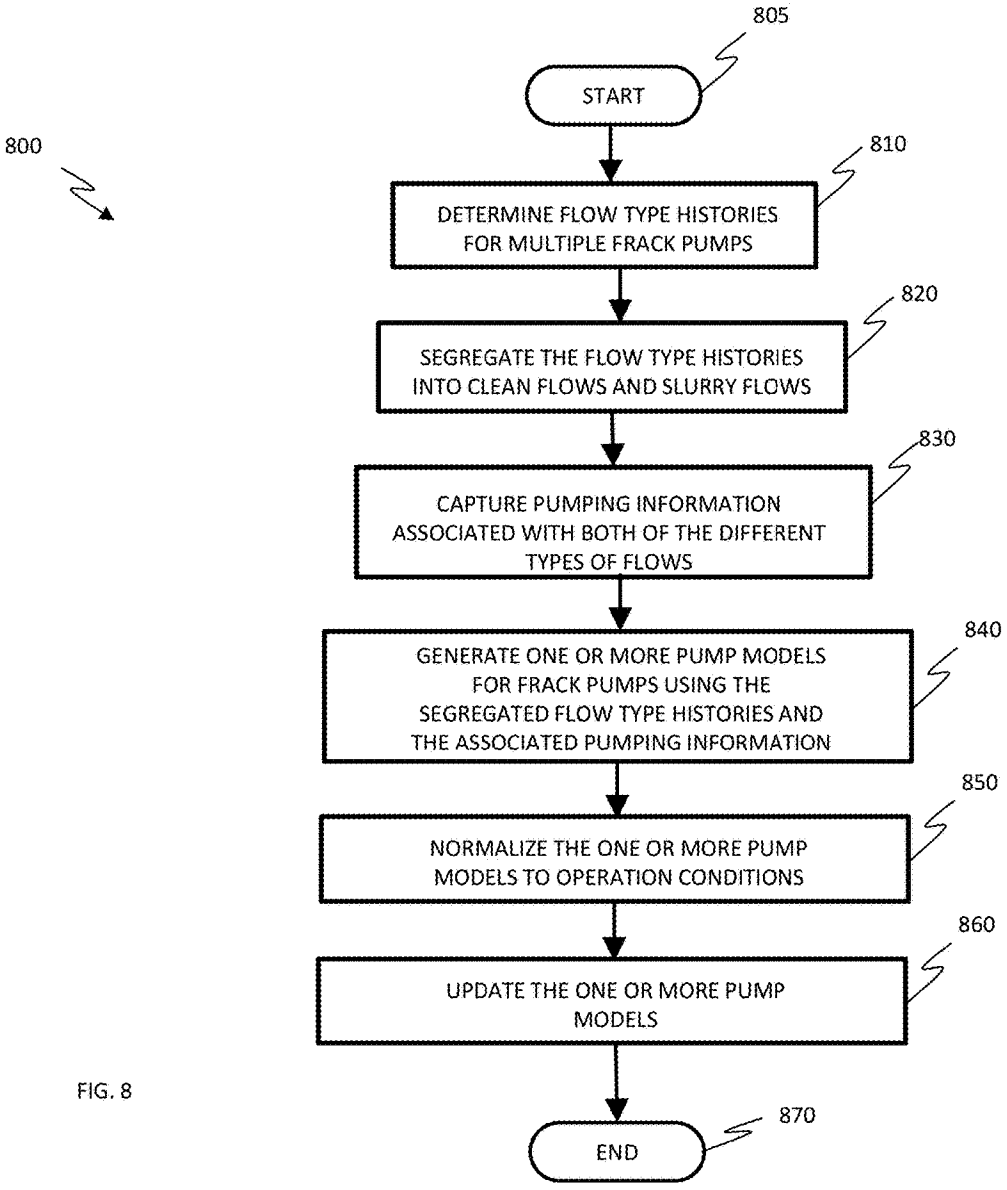
FIG. 8 illustrates a flow diagram of an example method of generating a probabilistic component life model for components of a frack pump carried out according to the principles of the disclosure.

By determining the proppant presence, the flow type can be determined for each of the frack pumps 230 and a flow type history can be calculated using the flow type and the amount of time or fluid volume for each flow type. The flow type histories from the frack pumps 230 can be used to manage usage of the frack pumps 230. For example, the flow type histories for one of the frack pumps 230 can be compared to one or more pump models to determine if usage for the particular one of the frack pumps 230 needs to change. The pump models can be created using flow type and corresponding flow type histories obtained as disclosed herein from previously operated frack pumps. FIG. 8 illustrates an example of generating pump models. Additionally, FIG. 3 illustrates a method of managing usage of a frack pump using flow type history and FIGS. 4 and 5 illustrate flow type histories corresponding to a clean flow and a slurry flow, respectively.

Figure 3:
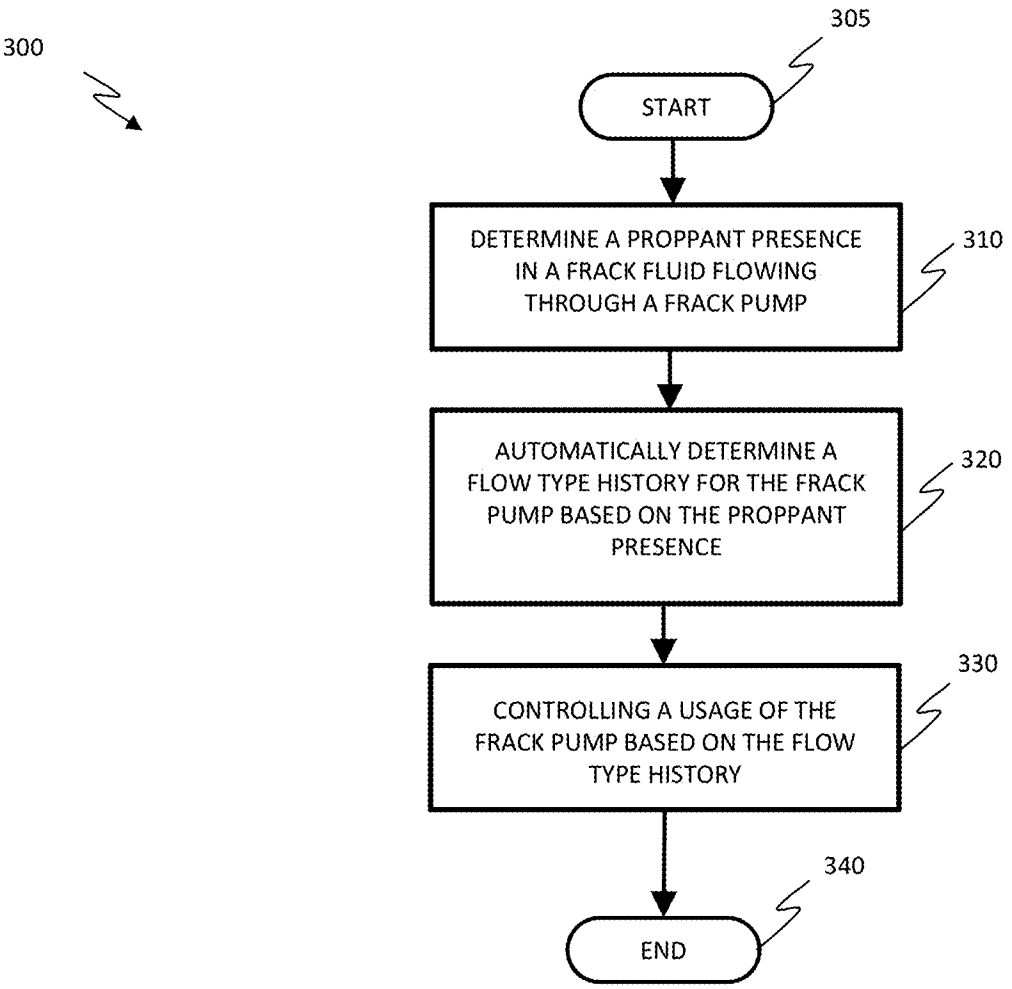
FIG. 3 illustrates a flow diagram of an example method of managing usage of a frack pump of a well fracking system carried out according to the principles of the disclosure.

FIG. 3 illustrates a flow diagram of an example method 300 of managing usage of a frack pump of a well fracking system carried out according to the principles of the disclosure. Method 300 begins in step 305.

Figure 6:
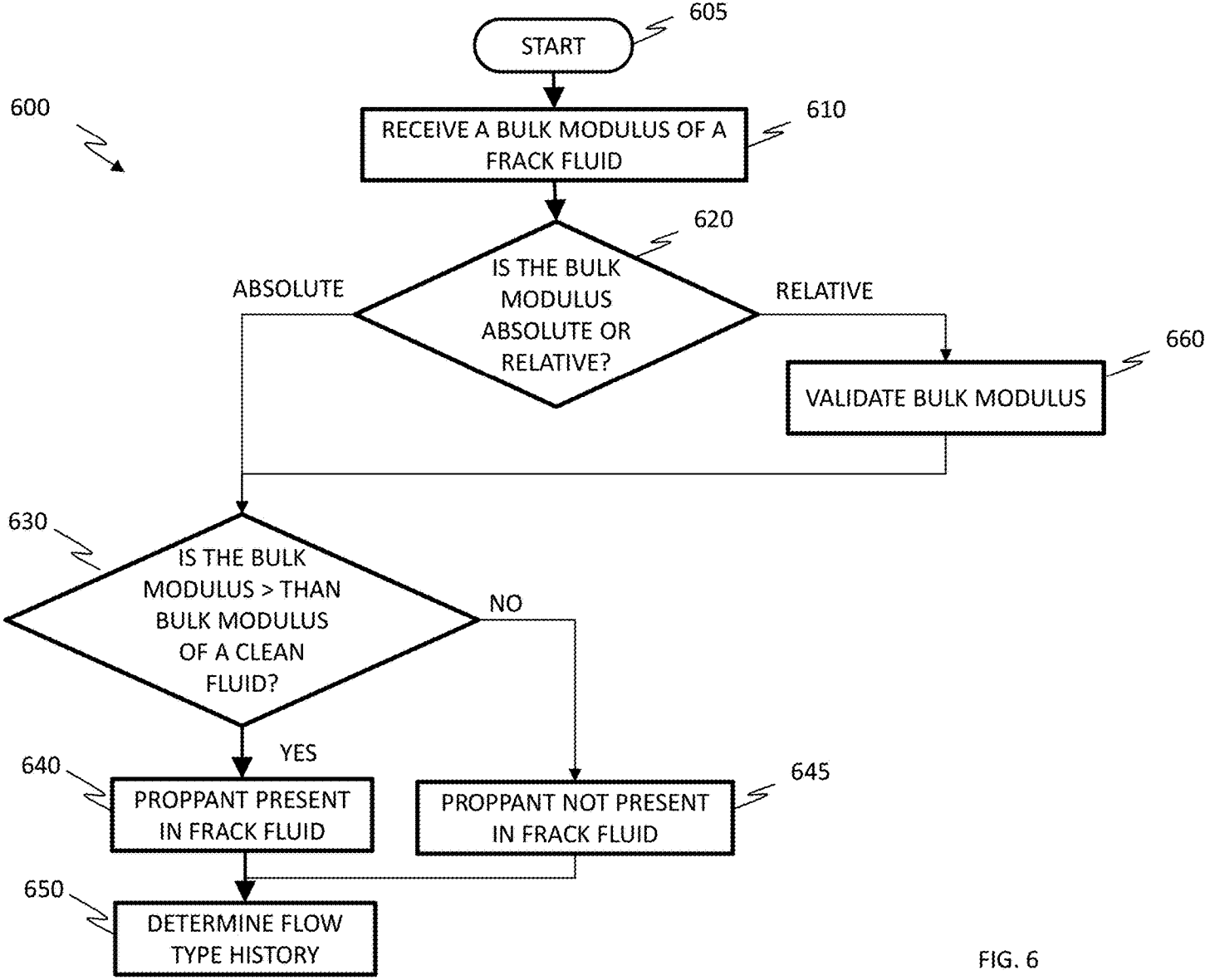
FIG. 6 illustrates a flow diagram of an example method of determining proppant presence in a frack fluid carried out according to the principles of the disclosure.

In step 310, a presence of proppant is determined in a frack fluid flowing through a frack pump. The presence of proppant can be determined over a period of time, such as over a fracking stage. The proppant presence can be based on absolute or relative measurements. An absolute or a relative bulk modulus can be used. Method 600 of FIG. 6 provides an example of determining the presence of a proppant using an absolute and a relative bulk modulus. Other sensors or methods can also be used to determine a proppant presence in the frack fluid via absolute or relative measurements. Relative measurements can be the detection of solids particles in the clean fluid. Various solid particle detection methods can be used such as optical or acoustic particle counters for such relative measurements. One or more sensors of the well fracking system can be used for the absolute or relative measurements indicating the presence of the proppant. The sensors can be part of a monitoring system of the well fracking system. The absence or presence of a proppant in the frack fluid indicates the type of flow through the frack pump. The flow types include clean flow, slurry flow, and when no flow is detected, no flow. Determining the presence of proppant in step 310 can be performed automatically.

In step 320, a flow type history for the frack pump is determined based on the proppant presence. The flow type history can be determined over a time period using the flow types corresponding to the proppant presence. The time period can be for one or more fracking stages. As such, the flow type history can provide a cumulative amount of time or fluid volume that the frack pump has been used for clean flow or slurry flow. Tracking the flow type for a frack pump in step 320 can be performed automatically.

A usage of the frack pump is controlled based on the flow type history in step 330. The usage can be controlled by retiring the pump, performing maintenance on the pump, or changing the usage of the pump, such as from a dirty pump to a clean pump. Controlling the usage can be performed during a fracking stage, between fracking stages, before a fracking operation, or after the fracking operation. Controlling the usage during the fracking stage can be performed automatically.

After step 330, method 300 continues to step 340 and ends.

FIG. 4 illustrates a diagram 400 of an example of a flow type history and associated data for a frack pump. In FIG. 4, the flow type history is for a clean flow. The first row of diagram 400 is the raw bulk modulus data of the frack fluid and the second row is the cleaned bulk modulus data. In other words, the raw bulk modulus data is processed to remove anomalies, noise, etc.

The third row and fourth row of the diagram 400 is the treating pressure of the frack pump and the flowrate of the frack pump. The fifth row is the proppant (represented by sand) concentration at the blender and the sixth row indicates clean frack fluid through the frack pump by the label of 2. In FIG. 4, the label of 2 is used but another label can be used. The x axis for both FIGS. 4 and 5 is time and can correspond to minutes, hours, or another measurement of time. The period of time can be the amount of time of a fracking stage. The y axes for each of the different rows in FIGS. 4 and 5 are typical units used for measuring the corresponding type of data.

FIG. 5 illustrates a diagram of another example of a flow type history and associated data for a frack pump. In FIG. 5, the flow type history is for a slurry flow. Rows one to six of FIG. 5 represent the same data as rows one to six of FIG. 4. Row six of FIG. 5 uses the label of 3 to indicate a proppant laden fluid but another label could be used. In both FIG. 4 and FIG. 5 there is no correlation between the bulk modulus and the proppant concentrations. If there were a correlation, the bulk modulus would be rising while the sand concentration is rising. This is further indication that this pump has no proppant running through it. However, in FIG. 5 there is a correlation between sand concentration and bulk modulus, which indicates there is proppant going through the pump. As the sand concentration is rising, the bulk modulus is also rising because the proppant has a much lower compressibility than the liquid.

FIG. 6 illustrates a flow diagram of an example method 600 of determining proppant presence in a frack fluid carried out according to the principles of the disclosure. Flow type histories can be determined using the presence or absence of proppant in the frack fluid. One or more steps of the method 600 can be performed automatically using one or more processors of a computing system, such as computing system 900 of FIG. 9. A series of operating instructions corresponding to one or more algorithms can direct the operation of one or more processors of the computing system to perform method 600. Method 600 uses an absolute or a relative bulk modulus. The method 600 begins in step 605.

In step 610, a bulk modulus of a frack fluid is received. A determination is made in decisional step 620 if the bulk modulus is an absolute bulk modulus. An absolute measurement of bulk modulus of the frack fluid can be obtained from a monitoring system, such as IntelliScan, or other device that can directly measure the bulk modulus. Another absolute measurement of bulk modulus for a frack fluid can be determined using various means of measuring the absolute density of the frack fluid and then calculating the proppant concentration from the absolute density of the fluid with inputs of a clean fluid density and an absolute volume of the proppant. Equation 1 below can be used for calculating the proppant concentration.

$$C_P = \frac{D_{SL} - D_L}{1 - (D_{SL})(V_{abs})}$$

In Equation 1, $D_{SL}$ and $D_L$ are the density of the slurry (or proppant fluid) and the clean liquid. $V_{abs}$ is the absolute volume of the proppant, which is known. Some examples of methods to measure density are Coriolis mass flowmeters, radioactive density measurements, calculating the density from a combination of data from a volumetric and momentum type flow meters and various other fluid density measurement devices.

If an absolute bulk modulus, the method 600 continues to step 630 where proppant presence is determined. In step 630, a proppant presence in a frack fluid can be determined by comparing the absolute bulk modulus to the bulk modulus of a clean fluid (no proppant). Anytime the bulk modulus of the clean frack fluid is less than the measured absolute bulk modulus (i.e., the absolute bulk modulus of the frack fluid is greater than the bulk modulus of the clean fluid), then the frack fluid has proppant. A margin of error, based on statistics or historical data, can be used for the comparison. The absolute bulk modulus for the clean fluid can be a manual entry or can be measured before proppant is added. The absolute bulk modulus for the frack fluid flowing through the frack pump can be determined by calibrating the strain gauge on the pump. Secondary devices can be used, such as a calibrated cylinder and piston and pressure transducer, to measure the bulk modulus for the clean fluid or the frack fluid.

When using the absolute bulk modulus of the base or clean fluid (such as the clean fluid from one of the fluid tanks 150 of FIG. 1) and the frack fluid, the calculation to determine proppant presence in the frack fluid is simpler and the total proppant concentration can be obtained therefrom. The proppant presence in the frack fluid can be determined using Equation 2 provided below:

$$C_P = \frac{V_S}{V_{abs}} = \left(\frac{V_L}{V_{abs}}\right)\left(\frac{1}{\frac{K}{K_S} + \frac{K}{K_L} - 1}\right)$$

In Equation 2,

K=Bulk modulus of liquid and solid $K_L$=Bulk modulus of clean liquid $K_S$=Bulk modulus of solid $V_L$=Volume of clean liquid V=Volume of solid $V_{abs}$=Absolute volume of solid (gal/lb)

Both Equations 1 and 2 are well known and understood by one skilled in the art.

Method 600 continues to step 640 where presence of proppant in the frack fluid is recognized, which indicates slurry flow, and can then be used to determine flow type history for the frack pump in step 650. Returning to step 630 if the absolute bulk modulus is not greater than the bulk modulus of the clean fluid, then method 600 continues to step 645 where the absence of proppant in the frack fluid is recognized, which indicates clean flow, and can then be used to determine flow type history for the frack pump in step 650.

Returning to decisional step 620, if a relative bulk modulus then the relative measurement will only indicate that there is proppant in the frack fluid when the relative measurement is greater than that of the clean fluid. For a relative bulk modulus, the bulk modulus needs to be validated before being used to determine proppant presence. The bulk modulus can be validated by one or more operating parameters of the frack pump, one or more operating parameters of the fracking system, or a combination of both. For example, for a relative bulk measurement indicating there is proppant in a clean fluid, a proppant concentration for the fracking system can be used to validate a proppant presence. The proppant concentration for the fracking system can be obtained from a blender of the fracking system that is mixing the proppant into the clean fluid. In addition to the proppant concentration, a pump rate and a pump pressure of the frack pump can be used for validation. Once validated in step 660, method 600 continues to step 630.

Figure 7:
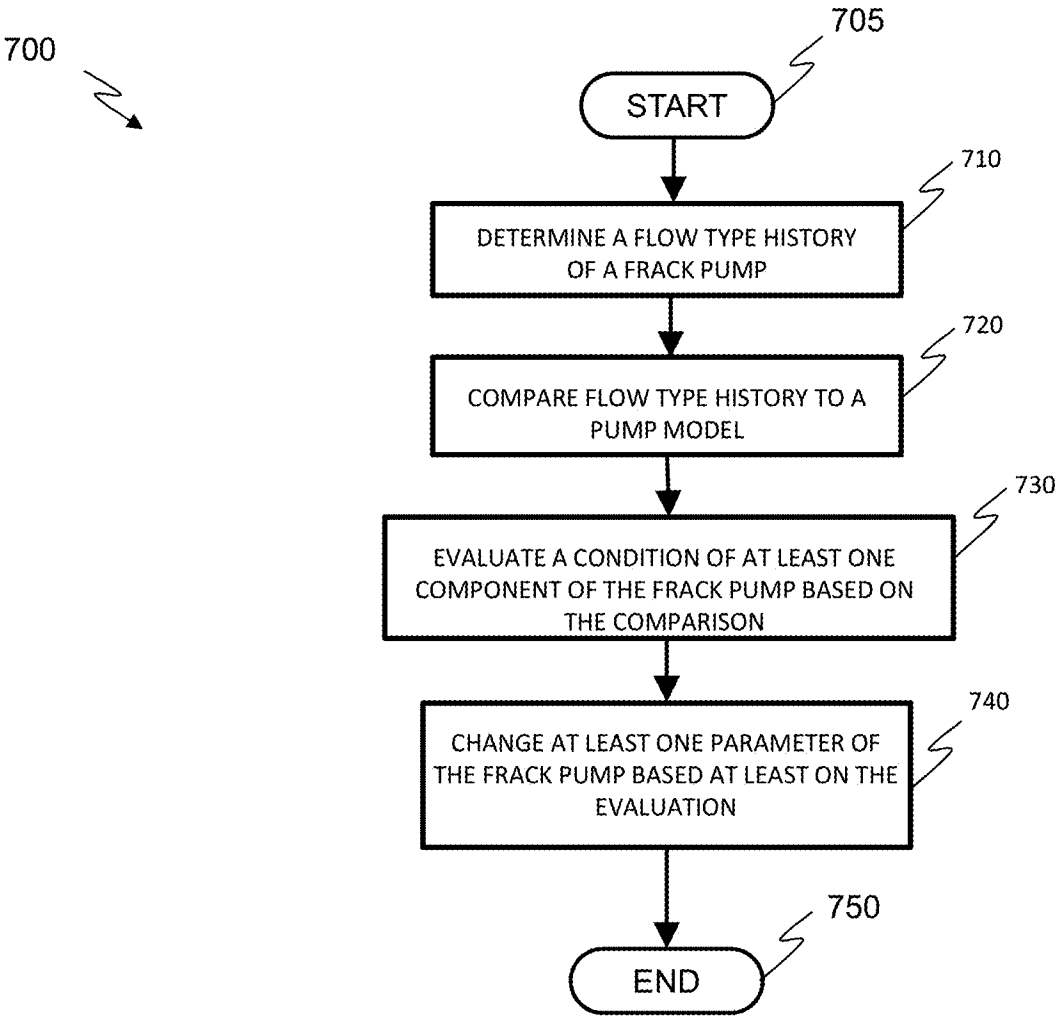
FIG. 7 illustrates a flow diagram of a method of evaluating pump components carried out according to the principles of the disclosure.

FIG. 7 illustrates a flow diagram of a method 700 of evaluating pump components carried out according to the principles of the disclosure. The components can be evaluated based on erosion, corrosion, or both caused by the frack fluid flow. Erosion and corrosion are examples of failure mechanisms that can affect the condition of pump components and cause component failure on their own, in combination, or can accelerate component failure due to damage from other failure mechanisms, such as fatigue. Fatigue is another example of a failure mechanism due to the number of pressure or load cycles and the pressure or load at the cycles. Sudden component failure can result from reduction in cross-sectional area due to erosion and/or corrosion that will prevent a component from containing an operating pressure. In addition to reduction of cross-sectional area, another condition can be cracking of a pump component that can also lead to failure of a pump component. One or more steps of the method 700 can be performed automatically using one or more processors of a computing system, such as computing system 900 of FIG. 9. A series of operating instructions corresponding to one or more algorithms can direct the operation of one or more processors of the computing system to perform method 700. The method 700 begins in step 705.

In step 710, a flow type history for a frack pump is determined. The flow type history is a quantitative representation of a flow type of the frack fluid in the pump over a time period or flow volume of the frack pump in operation. The flow type history can be determined according to step 320 of method 300.

The flow type history of the frack pump is compared to at least one pump model in step 720. The one or more pump models can be probabilistic component life models that are used to estimate the remaining life of one or more pump components. The pump models can be based on erosion, corrosion, or a combination of both erosion and corrosion. A pump model for fatigue can also be used by itself or with the erosion or corrosion models. The pump model can be created according to the method 800 of FIG. 8. Before comparing, both the flow type history and the pump model can be normalized.

In step 730, a condition of at least one component of the frack pump is evaluated based on the comparing. The condition can be from erosion due to pumping a slurry flow or from corrosion due to pumping both a clean flow and a slurry flow. The condition can also be due to fatigue or fatigue in combination with erosion, corrosion, or both erosion and corrosion. Based on the evaluation, the remaining life of pump components can be determined.

In step 740, at least one parameter of the frack pump is changed based at least on the evaluation performed in step 730. The one or more parameters can be identified as affecting the remaining life of a pump component determined by comparing the flow type history to a pump model based on the total exposure to varying erosion, varying corrosion, and total exposure of clean and dirty fluid at the time of failure on prior component failures and the evaluating of steps 720 and 730. The parameters include material type of the pump components, manufacturing process of the pump components, manufacturer of the pump, etc. Pump related factors of the frack pump can also be received and used for determining to change one or more parameters of the frack pump. The pump related factors include manufacturing date, changes in manufacturing process or material, etc. The frack pump parameter that is changed can correspond to one or more of the pump related factors. After step 740, the method 700 continues to step 750 and ends. The method 700 can be repeated multiple times for the same pump component and used for more than one type of pump component.

FIG. 8 illustrates a flow diagram of an example method 800 of generating a probabilistic component life model for components of a frack pump carried out according to the principles of the disclosure. The life model, or simply pump model as used herein, can be used to evaluate pump components and manage usage of frack pumps. The pump model can focus on component life based on erosion, corrosion, or a combination thereof. The pump model can also be used to focus on component life based on fatigue. One or more steps of the method 800 can be performed automatically using one or more processors of a computing system, such as computing system 900 of FIG. 9. A series of operating instructions corresponding to one or more algorithms can direct the operation of one or more processors of the computing system to perform method 800. Method 800 begins in step 805.

In step 810, flow type histories for multiple frack pumps are determined. A flow type history for each of the frack pumps can be determined according to step 320 of method 300 and method 600. The flow type histories include clean flow and slurry flow.

In step 820, the flow type histories for the frack pumps are segregated into clean flows and slurry flows. FIG. 4 illustrates an example of clean flow and FIG. 5 illustrates an example of a slurry flow.

In step 830, pumping information associated with both the clean flow and the slurry flow for each flow type history is captured. At least some of the pumping information can be part of the monitoring data that is captured via a monitoring system, such as monitoring system 250 of FIG. 2. The pumping information can include one or more of pressure, flowrate, proppant concentration, proppant type, proppant volume and rate, total fluid volume, proppant mesh, pump type, or pump size.

One or more pump models for frack pumps are generated using the segregated flow type histories and the associated pumping information in step 840. The pump models include one or more of probability of survival for planned future usage with known past usage, amount of future usage available at a specified probability of failure, current life consumed on pump components, or verification of split jobs.

In step 850, the one or more pump models are normalized. The one or more pump models can be normalized to characteristics and reference operating conditions (or parameters) of frack pumps. As such, comparisons between normalized flow type histories and normalized pump models can be made to determine, for example, remaining life of pump components as noted in method 700. Examples of characteristics and operating parameters include pump size (plunger stroke and diameter), pump speed (rpm), pump model, and pump pressure (psi). After step 850, the one or more pump models can be updated in step 860 based on the current flow of frack fluid being pumped by frack pumps during a fracking stage. After updating, the models can be normalized again as in step 850. The method 800 continues and ends at step 870. Normalization or equivalency is well known by those skilled in the art.

FIG. 9 illustrates a block diagram of an example of a computing system 900 constructed according to the principles of the disclosure. The computing system 900 can be located at a wellbore, such as in control unit 110 of FIG. 1, or can be remotely located from the wellbore. The computing system 900 includes one or more interfaces represented by interface 910, one or more memories or data storage represented by memory 920, and one or more processors represented by processor 930.

The interface 910 is a communication interface that includes the necessary circuitry, software, or combination thereof to send and receive data. The interface 910 can be a conventional interface used in the oil and gas industry. The interface 910 receives such data as monitoring data from a fracking system and sends such data as control signals to direct the operation of components of the fracking system. The control signals can be sent to automatic valves of the fracking system to control the delivery of frack fluid to frack pumps of the fracking system. The interface 910 can also receive pump models, pump related factors, and flow type histories that have been created and provide instructions for changing a parameter for one or more components of a frack pump (or frack pumps) based on an evaluation using the pump models, pump related factors, and flow type histories. The instructions can be provided to a display (not shown) associated with the computing system 900 for visual display or be sent to another computing system for implementation. The flow type histories of the frack pumps, the pump related factors, and the pumps models can be stored on the memory 920.

The memory 920 can include the necessary circuitry for storing data and operating instructions that direct the operation of the processor 930. The memory 920 can be a non-transitory memory. The operating instructions can be or can represent one or more algorithms directed to determining and/or updating flow type histories of frack pumps, controlling the type of frack fluid flow through the frack pumps using the flow type histories, and managing the usage of frack pumps. The operating instructions can also represent one or more algorithms directed to evaluating pump components and/or one or more algorithms directed to generating probabilistic life models. A single controller or computing device may not include the operating instructions to perform all of these functions. Instead, one computing device can be used for creating pump models, another one can be used for evaluating pump components, still another one for generating flow type histories, etc. Accordingly, the functionality of computing device 900 can be distributed to more than one computing device or system.

The processor 930 includes the necessary computing circuitry for processing data, for example, in series or in parallel, which includes substantially in parallel. The processor 930 cooperates with the memory 920 to operate according to the operating instructions stored on the memory 920. For example, the processor 930 can be configured to determine flow type histories of frack pumps, update flow type histories of frack pumps, control the type of frack fluid flowing through the frack pumps using the flow type histories, and manage the usage of frack pumps. The processor 930 can also be configured to evaluate pump components, generate instructions for changing one or more parameters of frack pumps, and generate probabilistic life models that can be used for evaluating the pump components. The processor 930 can identify parameters of the frack pump that can be changed using the evaluating and the pump related factors. The processor 930 can perform one or more of these various functions according to one or more of the methods 300, 600, 700, or 800.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate array (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, or read-only memory (ROM), to enable various types of digital data processors or computers to perform one, multiple or all of the steps of one or more of the above-described methods, or functions, systems or apparatuses described herein.

Portions of disclosed examples or aspects may relate to computer storage products with a non-transitory computer-readable medium that has program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Configured or configured to means, for example, designed, constructed, or programmed, with the necessary logic or features for performing a task or tasks. Examples of program code include both machine code, such as produced by a compiler, and files containing higher-level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions, and modifications may be made to the described aspects. It is also to be understood that the terminology used herein is for the purpose of describing particular aspects only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The disclosure provides the following aspects:

A. A method of managing usage of a frack pump of a fracking system, including: (1) obtaining, for a time period or fluid volume, a proppant presence for a frack fluid being pumped by a frack pump, (2) automatically determining a flow type history for the frack pump over the time period or fluid volume based at least on the proppant presence, and (3) controlling a usage of the frack pump using the flow type history.

B. A fracking system for a wellbore, including: (1) frack pumps and (2) a controller having one or more processors to perform operations that include managing usage of one or more of the frack pumps based on a flow type history of the one or more frack pumps that is automatically determined based on a proppant presence in a frack fluid pumped by the one or more of the frack pumps.

C. A computer program product having a series of operating instructions stored on a non-transitory computer-readable medium that directs one or more processors when executed thereby to perform operations to manage usage of a frack pump, the operations including: (1) obtaining, over a time period or fluid volume, a proppant presence for a frack fluid being pumped by a frack pump, (2) automatically determining a flow type history for the frack pump over the time period or flow volume based at least on the proppant presence, and (3) controlling a usage of the frack pump using the flow type history.

Each of the aspects A, B, and C can have one or more of the following additional elements in combination: Element 1: wherein obtaining the proppant presence is based on a bulk modulus of the frack fluid. Element 2: wherein the bulk modulus is an absolute bulk modulus or a relative bulk modulus. Element 3: further comprising validating the proppant presence when the bulk modulus is a relative bulk modulus using one or more operating parameters of the frack pump, one or more operating parameters of the fracking system, or a combination of both. Element 4: wherein the one or more operating parameters of the fracking pump include a pump rate, a pump pressure, or both. Element 5: wherein the one or more operating parameters of the fracking system include a proppant concentration of the frack fluid provided by a blender of the fracking system. Element 6: wherein the proppant presence is determined by a fluid density sensor or a speed of sound sensor. Element 7: wherein the flow type history includes flow types of no flow, clean flow, or slurry flow. Element 8: wherein the time period or fluid volume corresponds to a fracking stage of a well system using the frack pump and the flow type history includes different flow types. Element 9: wherein altering the usage is based on comparing the normalized flow type history to a normalized pump model. Element 10: wherein the controlling the usage includes retiring the pump, performing maintenance on the pump, or changing a usage of the pump. Element 11: wherein changing the usage includes switching the pump from a dirty pump to a clean pump or from a clean pump to a dirty pump. Element 12: wherein the time period corresponds to a fracking stage of a well system and changing the usage is automatically performed during the fracking stage. Element 13: wherein the proppant presence is based on a bulk modulus of the frack fluid. Element 14: wherein the flow type history is automatically determined over a time period or flow volume of the frack fluid being pumped. Element 15: wherein the time period or flow volume corresponds to a fracking stage of the wellbore using the one or more of the frack pumps and the flow type history includes different flow types. Element 16: wherein the flow type history includes flow types of no flow, clean flow, or slurry flow. Element 17: wherein the controlling the usage includes retiring, performing maintenance, or changing a usage of the one or more of the frack pumps. Element 18: further comprising a valve system having an automatic valve, wherein controlling the usage includes changing a flow type of the one or more of the frack pumps during a frack stage of the wellbore by operating the automatic valve. Element 19: wherein obtaining the proppant presence is based on a bulk modulus of the frack fluid and when the bulk modulus is a relative bulk modulus, validating the proppant presence using one or more operating parameters of the frack pump, one or more operating parameters of the fracking system, or a combination of both. Element 20: wherein the one or more operating parameters of the fracking pump include a pump rate, a pump pressure, or both, and the one or more operating parameters of the fracking system include a proppant concentration of the frack fluid provided by a blender of the fracking system. Element 21: wherein the time period or flow volume corresponds to a fracking stage of a well system and changing the usage is automatically performed during the fracking stage.

What is claimed is:

1. A method of managing usage of a frack pump of a fracking system, comprising:

obtaining, for a time period or a fluid volume, a proppant presence for a frack fluid being pumped by a frack pump;

automatically determining a flow type history for the frack pump over the time period or the fluid volume based at least on the proppant presence, wherein the flow type history includes different flow types; and controlling a usage of the frack pump using the flow type history.

2. The method as recited in claim 1, wherein the bulk modulus is an absolute bulk modulus or a relative bulk modulus.

3. The method as recited in claim 2, wherein the validating of the proppant presence is a validating of the relative bulk modulus using one or more operating parameters of the frack pump, one or more operating parameters of the fracking system, or a combination of both.

4. The method as recited in claim 3, wherein the one or more operating parameters of the fracking pump include a pump rate, a pump pressure, or both.

5. The method as recited in claim 3, wherein the one or more operating parameters of the fracking system include a proppant concentration of the frack fluid provided by a blender of the fracking system.

6. The method as recited in claim 1, wherein the proppant presence is determined by a fluid density sensor or a speed of sound sensor.

7. The method as recited in claim 1, wherein the flow type history includes flow types of no flow, clean flow, or slurry flow.

8. The method as recited in claim 1, wherein the time period or the fluid volume corresponds to a fracking stage of a well system using the frack pump.

9. The method as recited in claim 1, wherein controlling the usage of the frack pump is based on comparing a normalized flow type history to a normalized pump model having flow type histories for multiple frack pumps.

10. The method as recited in claim 1, wherein the controlling the usage includes retiring the pump, performing maintenance on the pump, or changing a usage of the pump.

11. The method as recited in claim 9, wherein changing the usage includes switching the pump from a dirty pump to a clean pump or from a clean pump to a dirty pump.

12. The method as recited in claim 11, wherein the time period corresponds to a fracking stage of a well system and changing the usage is automatically performed during the fracking stage.

13. A fracking system for a wellbore, comprising:

frack pumps; and a controller having one or more processors configured to perform operations that include:

automatically determining a flow type history of one or more of the frack pumps based on a proppant presence in a frack fluid pumped by the one or more of the frack pumps, the proppant presence being based on a bulk modulus of the frack fluid;

validating the proppant presence; and managing usage of the one or more of the frack pumps based on the flow type history.

14. The fracking system as recited in claim 13, wherein the flow type history is automatically determined over a time period or a flow volume of the frack fluid being pumped.

15. The fracking system as recited in claim 14, wherein the time period or the flow volume corresponds to a fracking stage of the wellbore using the one or more of the frack pumps.

16. The fracking system as recited in claim 13, wherein the flow type history includes flow types of no flow, clean flow, or slurry flow.

17. The fracking system as recited in claim 13, wherein the controlling the usage includes retiring, performing maintenance, or changing a usage of the one or more of the frack pumps.

18. The fracking system as recited in claim 13, further comprising a valve system having an automatic valve, wherein controlling the usage includes changing a flow type of the one or more of the frack pumps during a frack stage of the wellbore by operating the automatic valve.

19. A computer program product having a series of operating instructions stored on a non-transitory computer-readable medium that directs one or more processors when executed thereby to perform operations to manage usage of a frack pump, the operations comprising:

obtaining, over a time period or a fluid volume, a proppant presence for a frack fluid being pumped by a frack pump based on a bulk modulus of the frack fluid;

validating the proppant presence;

automatically determining a flow type history for the frack pump over the time period or the flow volume based at least on the proppant presence, wherein the flow type history includes different flow types; and controlling a usage of the frack pump using the flow type history.

20. The computer program product as recited in claim 19, wherein the bulk modulus of the frack fluid is a relative bulk modulus, the validating of the proppant presence is based on one or more operating parameters of the frack pump, one or more operating parameters of the fracking system, or a combination of both.

21. The computer program product as recited in claim 20, wherein the one or more operating parameters of the fracking pump include a pump rate, a pump pressure, or both, and the one or more operating parameters of the fracking system include a proppant concentration of the frack fluid provided by a blender of the fracking system.

22. The computer program product as recited in claim 20, wherein the time period or the flow volume corresponds to a fracking stage of a well system and changing the usage is automatically performed during the fracking stage.

* * * * *